US006969210B1

(12) United States Patent
Newell

(10) Patent No.: US 6,969,210 B1
(45) Date of Patent: Nov. 29, 2005

(54) MULTI-LUMEN APPLICATOR IMPLEMENTS AND APPLICATION METHOD

(76) Inventor: Robert L. Newell, 36 Passaic Ave., West Paterson, NJ (US) 07424

( * ) Notice: Subject to any disclaimer, the term of this patent is extended or adjusted under 35 U.S.C. 154(b) by 0 days.

(21) Appl. No.: 10/691,792

(22) Filed: Oct. 23, 2003

(51) Int. Cl.[7] ..... A46B 11/04; A47L 13/22
(52) U.S. Cl. ..... 401/284; 401/285
(58) Field of Search ..... 401/282–291

(56) References Cited

U.S. PATENT DOCUMENTS

| | | | | |
|---|---|---|---|---|
| 654,414 | A | 7/1900 | Redington | |
| RE12,067 | E | 12/1902 | Wiens | |
| 1,080,574 | A | 12/1913 | Moss | |
| 1,336,604 | A | 4/1920 | Baker | |
| 1,428,807 | A | 9/1922 | Rose | |
| 1,571,338 | A * | 2/1926 | Kratochvil | 401/284 |
| 1,598,968 | A | 9/1926 | Johnson | |
| 2,253,779 | A | 8/1941 | Gutierrez | |
| 2,705,335 | A * | 4/1955 | Glassman et al. | 401/284 |
| 2,945,252 | A | 7/1960 | Martineau, Jr. | |
| 3,499,686 | A | 3/1970 | Landen et al. | |
| 4,795,218 | A | 1/1989 | Seidler | |
| 4,990,016 | A | 2/1991 | Seidler | |
| 5,702,194 | A * | 12/1997 | Hsu | 401/284 |
| 5,816,804 | A | 10/1998 | Fischer | |

* cited by examiner

*Primary Examiner*—Tuan Nguyen
(74) *Attorney, Agent, or Firm*—Arthur Jacob

(57) ABSTRACT

A fluid material is applied to a surface by an applicator implement shown in the form of a brush having a stem and an applicator in the form of bristles supplied with the fluid material through an array of relatively small diameter lumens extending along the stem of the brush and delivering the fluid material to the bristles in a corresponding array of small streams of fluid material directed along the bristles to lay down the fluid material in an essentially even distribution of regulated amounts of fluid material along the bristles.

18 Claims, 3 Drawing Sheets

MULTI-LUMEN APPLICATOR IMPLEMENTS AND APPLICATION METHOD

The present invention relates generally to the application of fluid materials to a surface utilizing an applicator implement and pertains, more specifically, to applicator implements and method in which the fluid material is delivered to the applicator of an applicator implement through multiple small lumens in the implement, to be laid down upon the applicator in corresponding small streams directed along the applicator for subsequent application to the surface.

One of the most common methods for applying a fluid material to a surface is through the utilization of an applicator implement, such as a brush having bristles which pick up the material and then lay down the material on the surface. A myriad of applicator implements has been proposed and developed for applying a wide variety of materials to many different surfaces. Among these implements are those in which fluid materials, such as paints and other coatings, cleaning solutions, adhesives, cosmetics, and even pharmaceutical preparations, are applied by delivering the fluid material to the applicator of the implement from a source connected directly to the implement and then applying the material onto the surface. Many of these materials require immediate application upon exposure to ambient atmosphere. For example, some coatings, adhesives and pharmaceutical preparations must be applied, in an even application of closely regulated amounts, with minimal residence time on the applicator of an implement for effective application to the selected surface. In particular, where the fluid material is to be applied in very small volumes, precise distribution and regulation, together with immediate application becomes critical to the effectiveness of the applied material.

The present invention provides improvements in the application of fluid materials utilizing implements constructed to be connected directly to a source of fluid material for delivery of the fluid material to the applicator of the implement and subsequent application of the delivered material to a surface. As such, the present invention attains several objects and advantages, some of which are summarized as follows: Enables the delivery of a fluid material to the applicator of an applicator implement, such as to the bristles of a brush, from a source connected directly to the implement, with better control of the flow and distribution of the material to the applicator for more precise application to a surface; allows closely regulated amounts of fluid material to be applied to a surface by an applicator, such as the bristles of a brush, with the fluid material more evenly distributed and applied essentially immediately upon delivery to the applicator so as to minimize exposure of the fluid material to the ambient atmosphere while residing at the applicator; provides increased accuracy in delivering even very small volumes of fluid material to the applicator of a smaller applicator implement, with better distribution over the applicator, for immediate, more precise application to a surface; simplifies a more even application of precise amounts of fluid material to carefully selected areas of a surface; provides a simplified and versatile applicator construction capable of economical manufacture in large numbers of consistent high quality, in a wide range of sizes and materials for use in connection with the application of a wide variety of fluid materials; provides a relatively compact and rugged applicator implement construction capable of exemplary performance in a wide variety of applications.

The above objects and advantages, as well as further objects and advantages, are attained by the present invention which may be described briefly as an improvement in an applicator implement having an applicator for applying a fluid material from a source to a surface, the improvement comprising: a stem having a first end and a second end, and an outer peripheral surface extending along the stem between the first end and the second end, in a direction along an axis; an applicator including a first portion secured to the stem adjacent the first end of the stem and a second portion projecting beyond the first end in a direction away from the second end, the first portion of the applicator being spaced inwardly from the outer peripheral surface toward the axis, and the second portion having an outer peripheral boundary; a transverse area extending across the stem, adjacent the first end of the stem, between the outer peripheral surface and the outer peripheral boundary; and a plurality of lumens extending through the stem from the first end to the second end, the lumens extending along the direction of the axis and spaced apart from one another in an array around the axis, each lumen being spaced from the axis and from the outer peripheral surface to lie between the axis and the outer peripheral surface, each lumen having an inlet adjacent the second end of the stem for receiving fluid material to be conducted from the source through the lumen, an outlet adjacent the first end of the stem for delivering the fluid material received at the inlet, and a transverse cross-sectional area, at least at the outlet, substantially smaller than the transverse area adjacent the first end of the stem, each outlet being located between the outer peripheral boundary of the second portion of the applicator and the outer peripheral surface and juxtaposed with the outer peripheral boundary of the second portion of the applicator for delivering the fluid material in a plurality of separate streams of relatively small cross-sectional area corresponding to the plurality of lumens, with the streams directed to lay down the delivered fluid material along the second portion of the applicator at the outer peripheral boundary of the second portion of the applicator.

Additionally, the present invention provides a method for delivering a fluid material to an applicator of an applicator implement for subsequent application to a surface, the applicator extending along an axis and having an outer peripheral boundary, the method comprising: delivering the fluid material in a plurality of separate small streams juxtaposed with the outer peripheral boundary of the applicator, the streams being spaced apart from one another in an array around the axis and directed such that the fluid material is laid down along the applicator at the outer peripheral boundary of the applicator.

Further, the present invention includes a method for delivering a fluid material to bristles of an applicator brush for subsequent application to a surface, the bristles extending along an axis in a bristle group having an outer peripheral boundary, the method comprising: delivering the fluid material in a plurality of separate small streams juxtaposed with the outer peripheral boundary of the bristle group, the streams being spaced apart from one another in an array around the axis and directed such that the fluid material is laid down along the bristles at the outer peripheral boundary of the bristle group.

The invention will be understood more fully, while still further objects and advantages will become apparent, in the following detailed description of preferred embodiments of the invention illustrated in the accompanying drawing, in which.

Figure 1:
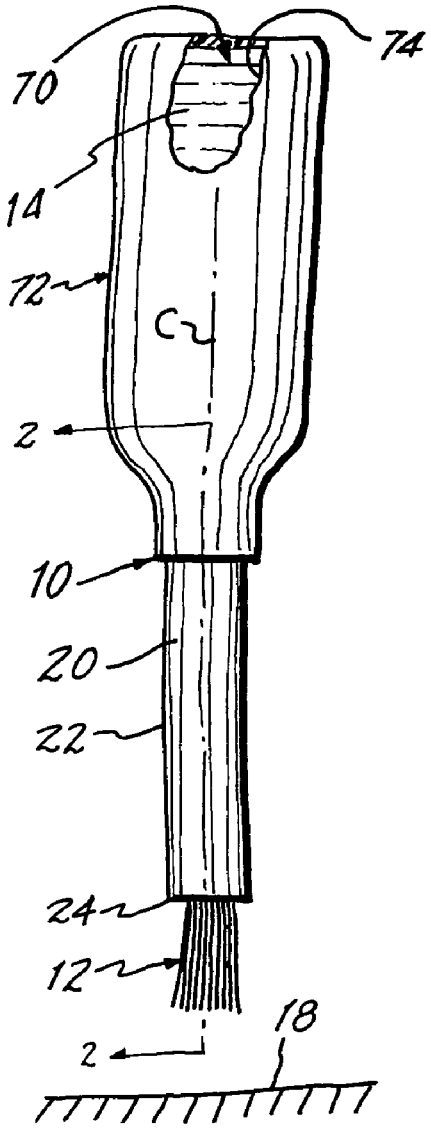
FIG. 1 is an elevational view of an applicator in the form of a brush constructed in accordance with the present invention.
Figure 2:
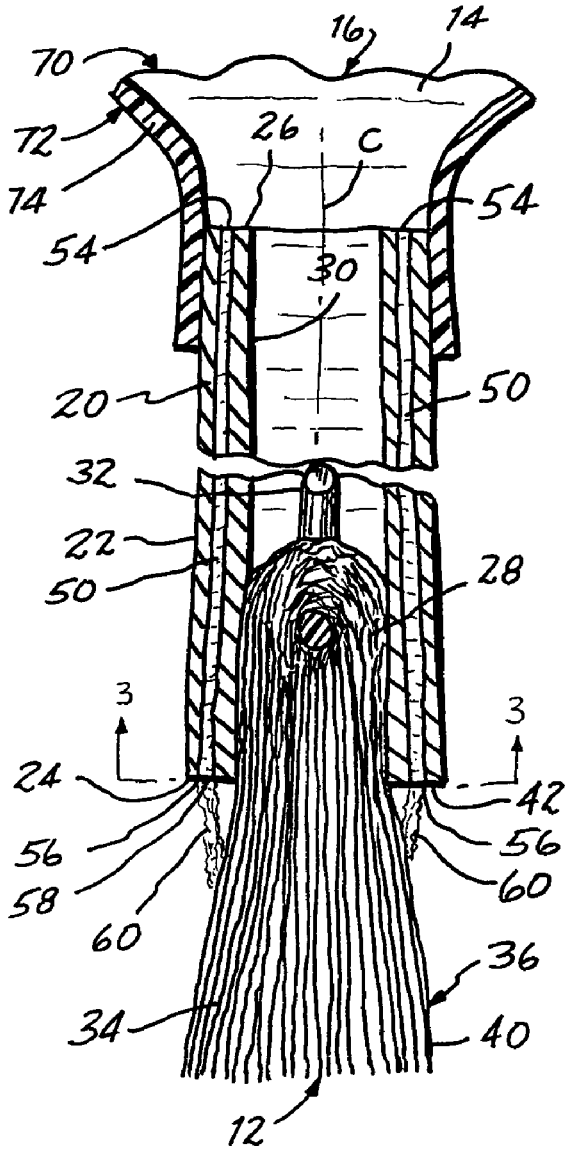
FIG. 2 is an enlarged, fragmentary longitudinal cross-sectional view taken along line 2—2 of FIG. 1.
Figure 3:
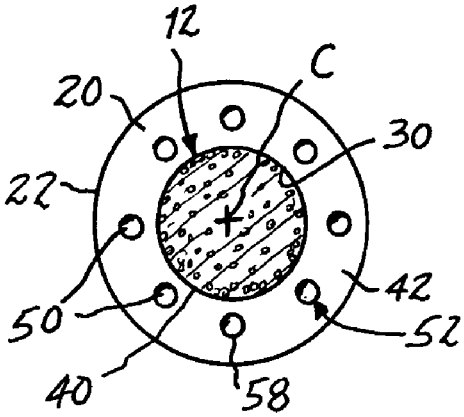
FIG. 3 is a transverse cross-sectional view taken along line 3—3 of FIG. 2.

Referring now to the drawing, and especially to FIGS. 1 through 3 thereof, an applicator implement constructed in accordance with the present invention is illustrated in the form of an applicator brush 10 and is shown having an applicator in the form of bristles 12 for applying a fluid material 14, supplied from a source 16, to a surface 18. Brush 10 includes a stem shown in the form of a cylindrical shaft 20 having an outer peripheral surface in the form of a cylindrical surface 22 extending along an axis, illustrated as a central axis C, between a first end 24 and a second end 26.

Bristles 12 are secured to shaft 20 adjacent first end 24 and project axially beyond the first end 24 in an axial direction away from second end 26, as is now well known in the construction of brushes. In the preferred arrangement, bristles 12 include first portions 28 anchored within a bore 30 extending into the shaft 20, coaxial with axis C, from the first end 24 toward the second end 26 by means of a staple 32, as described more fully in U.S. Pat. Nos. 5,159,736 and 5,217,279, to secure bristles 12 to the shaft 20. Second portions 34 of the bristles 12 establish a bristle group 36 projecting axially away from the first end 24 of shaft 20, bristle group 36 having an outer peripheral boundary 40. The relative diameters of shaft 20 and the bore 30 are such that the outer peripheral boundary 40 is spaced radially inwardly from the cylindrical surface 22 at first end 24, establishing a generally annular transverse area 42 at the first end 24, between the cylindrical surface 22 and the outer peripheral boundary 40.

A plurality of lumens 50 extend through shaft 20, from the second end 26 to the first end 24, the lumens 50 extending along the direction of axis C, generally parallel to and spaced radially outwardly from axis C, spaced radially inwardly from cylindrical surface 22, and spaced apart circumferentially from one another in a cylindrical array 52 around and coaxial with axis C. Each lumen 50 has an inlet 54 adjacent the second end 26 of the shaft 20 and communicating with the source 16 for receiving fluid material 14 to be conducted from the source 16 through the lumen 50, and an outlet 56 adjacent the first end 24 for delivering the conducted fluid material 14 received at the inlet 54 to the bristle group 36. Each outlet 56 is located within the transverse area 42, radially between the cylindrical surface 22 and the bore 30, and each lumen 50 has a transverse cross-sectional area 58, at least at outlet 56, substantially smaller than the transverse area 42, the cross-sectional area 58 being shown having a circular configuration. Outlets 56 are juxtaposed with the outer peripheral boundary 40 of bristle group 36 such that the fluid material 14 is delivered to the bristle group 36 in a plurality of streams 60 of relatively small cross-sectional area, corresponding to the plurality of lumens 50 and the small transverse cross-sectional area 58 at each outlet 56, directed along the bristles 12 at the outer peripheral boundary 40 of the bristle group 36. In this manner, fluid material 14 is laid down on the bristles 12 in more evenly distributed, accurately regulated, relatively small volumes for minimal residence time between placement on the bristles 12 and application to the surface 18.

In the embodiment of FIGS. 1 through 3, bore 30 is extended beyond the first portion 28 of bristles 12 toward the second end 26 of shaft 20 to communicate, at second end 26, with the source 16 so that fluid material 14 is delivered to bristles 12 through the bore 30, as well as through lumens 50. In this manner, the volume of fluid material 14 delivered to the bristles 12 is supplemented, while being more evenly distributed, enabling the delivery of particular fluid materials 14 which are to be supplied in greater amounts for subsequent application by bristles 12.

The configuration of shaft 20, with the coaxial array of lumens 50 and axial bore 30 lends itself to simple and economical manufacture in a range of dimensions and of a variety of materials best suited to any one of many fluid materials to be applied by brush 10. For example, shaft 20 is readily made by extrusion of metals or synthetic polymeric materials.

In the illustrated embodiment, the source 16 of fluid material 14 is integrated with brush 10 and is shown in the form of a reservoir 70 of fluid material 14 held within a container 72 having a resiliently flexible wall 74, such as those containers commonly referred to as "squeeze-bottles". Container 72 is attached directly to the second end 26 of shaft 20 such that the lumens 50, and bore 30, communicate directly with the reservoir 70. Thus, fluid material 14 is delivered directly to lumens 50, and to bore 30, and conducted through lumens 50, and through bore 30, merely by squeezing the wall 74 of container 72 to drive fluid material 14 from reservoir 70 into the lumens 50, and the bore 30.

Figure 4:
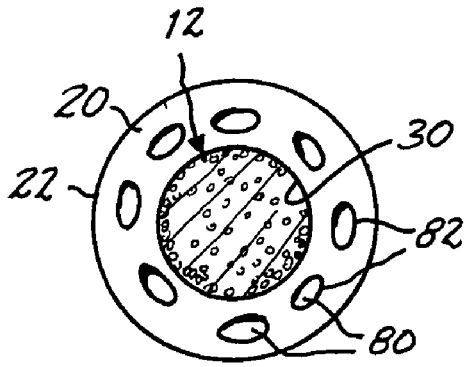
FIG. 4 is a transverse cross-sectional view similar to FIG. 3 and showing an alternate construction.

The configuration of the cross-sectional area 58 of the lumens 50, though shown circular in FIG. 3, may be constructed with other cross-sectional configurations. Thus, for example, in the embodiment illustrated in FIG. 4, lumens 80 are provided with an elliptical cross-sectional configuration 82.

Figure 5:
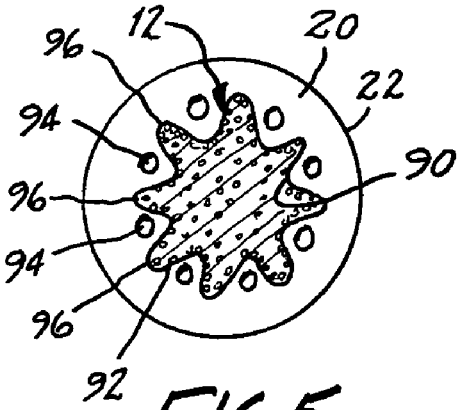
FIG. 5 is a transverse cross-sectional view similar to FIG. 3 and showing another alternate construction.

In the embodiment of FIG. 5, a central bore 90 within which bristles 12 are anchored is provided with a star-like cross-sectional configuration 92 and the lumens 94 are located between points 96 of the star-like cross-sectional configuration 92, placing the lumens 94 such that fluid material is delivered to bristles 12 circumferentially between bristles 12 located within the points 96 of the configuration 92, thereby enabling a more intimate contact between the delivered fluid material and the bristles 12.

Figure 6:
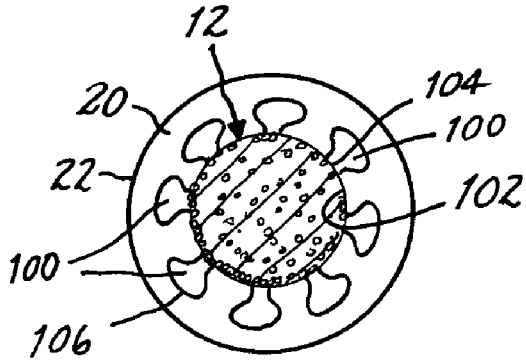
FIG. 6 is a transverse cross-sectional view similar to FIG. 3 and showing still another alternate construction.

In the embodiment of FIG. 6, lumens 100 are seen to communicate with central bore 102 along at least a portion 104 of the length of each lumen 100 such that fluid material in the lumens 100 is placed in direct contact with bristles 12 as the fluid material is delivered through the lumens 100. In the preferred embodiment, each portion 104 communicates with central bore 102 at least at the outlet 106 of the lumen 100.

Figure 7:
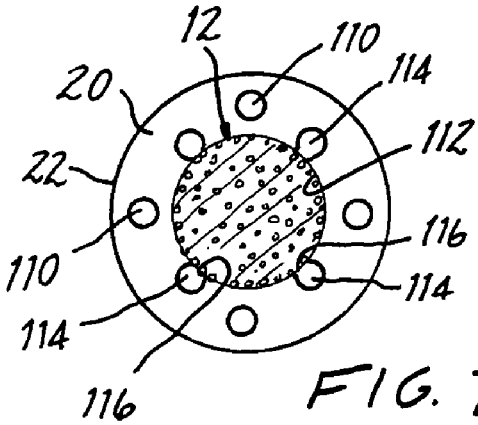
FIG. 7 is a transverse cross-sectional view similar to FIG. 3 and showing yet another alternate construction.

In the embodiment of FIG. 7, some lumens 110 are spaced from central bore 112, while other lumens 114 communicate with central bore 112 along at least a portion 116 of the length of each lumen 114, thereby gaining the advantages provided by both of the embodiments of FIGS. 3 and 6.

Figure 8:
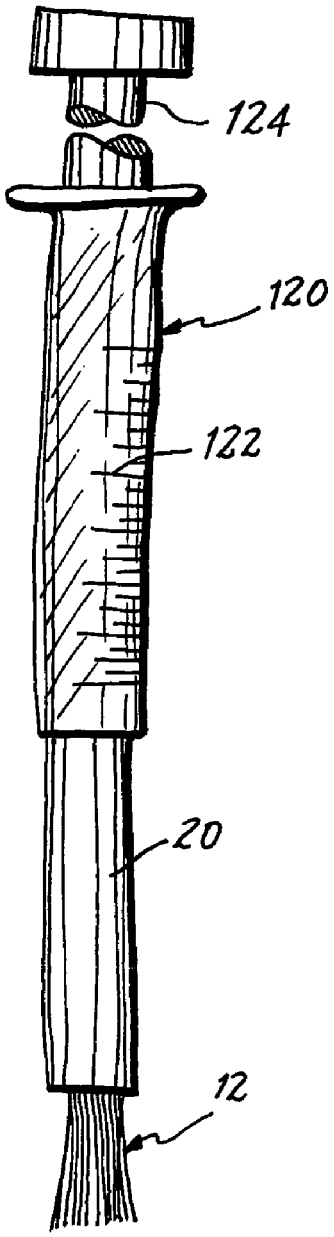
FIG. 8 is an elevational view of another applicator implement constructed in accordance with the present invention.

In the embodiment illustrated in FIG. 8, container 72 has been replaced with a pump in the form of a syringe 120 having graduations 122 enabling an even more accurate regulation and metering of small amounts of fluid material to be driven by a plunger 124 through lumens 50 for delivery to bristles 12.

Figure 9:
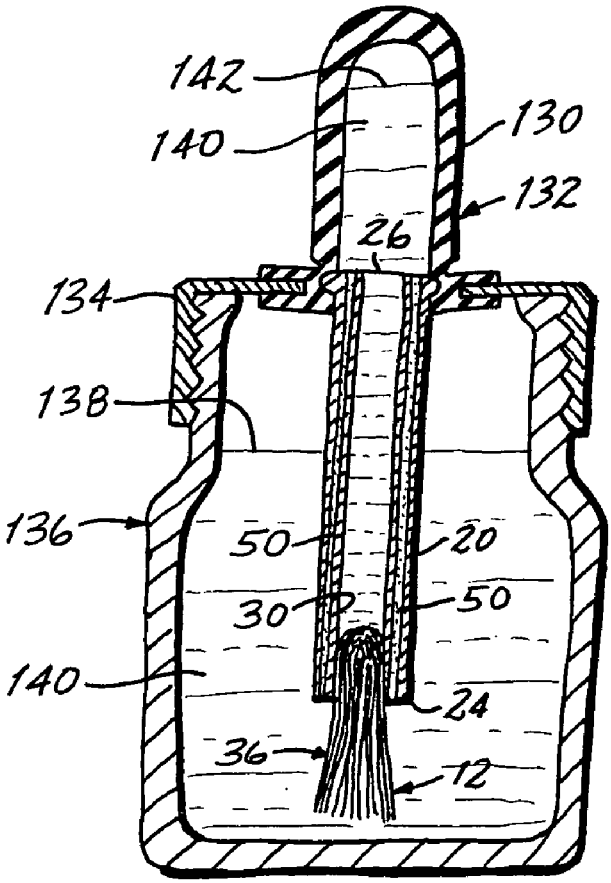
FIG. 9 is a longitudinal cross-sectional view of still another applicator implement constructed in accordance with the present invention.

Turning now to the embodiment of the invention illustrated in FIG. 9, shaft 20 is seen to be affixed to a pump in the form of a dropper bulb 130 to establish a dropper-like assembly 132. In the illustrated example, the dropper-like assembly 132 is integrated with a threaded cap 134 adapted to be threaded onto a bottle 136 in which there is contained a supply 138 of fluid material 140. With the first end 24 of shaft 20 immersed in the supply 138, the dropper bulb 130 is operated to draw fluid material 140 through lumens 50 and, where the bore 30 extends to the second end 26, through bristle group 36 into bore 30, toward the second end 26 and into dropper bulb 130 to establish a reservoir 142 of fluid material 140 within the dropper bulb 130. Subsequent operation of dropper bulb 130 by squeezing the dropper bulb 130 then will drive fluid material 140 from reservoir 142 to deliver the drawn fluid material 140 to the bristle group 36 for application to a surface. Thus, lumens 50 serve as bypass passages enabling fluid material 140 to be moved from supply 138 into reservoir 142 within dropper bulb 130 for subsequent delivery to the bristles 12 and application to a selected surface.

While in the illustrated embodiments, improved applicator implements have been shown and described in the form of brushes having applicators constructed of bristles, it will be apparent that other applicators are available for use in place of bristles. For example, foamed synthetic polymeric applicators, textile applicators and the like, all of which are known in applicator implements, may be utilized in place of the illustrated bristles for attaining benefits provided by the improvements of the present invention.

It will be seen that the present invention attains the several objects and advantages summarized above, namely: Enables the delivery of a fluid material to the applicator of an applicator implement, such as to the bristles of a brush, from a source connected directly to the implement, with better control of the flow and distribution of the material to the applicator for more precise application to a surface; allows closely regulated amounts of fluid material to be applied to a surface by an applicator, such as the bristles of a brush, with the fluid material more evenly distributed and applied essentially immediately upon delivery to the applicator so as to minimize exposure of the fluid material to the ambient atmosphere while residing at the applicator; provides increased accuracy in delivering even very small volumes of fluid material to the applicator of a smaller applicator implement, with better distribution over the applicator, for immediate, more precise application to a surface; simplifies a more even application of precise amounts of fluid material to carefully selected areas of a surface; provides a simplified and versatile applicator construction capable of economical manufacture in large numbers of consistent high quality, in a wide range of sizes and materials for use in connection with the application of a wide variety of fluid materials; provides a relatively compact and rugged applicator implement construction capable of exemplary performance in a wide variety of applications.

It is to be understood that the above detailed description of preferred embodiments of the invention is provided by way of example only. Various details of design, construction and procedure may be modified without departing from the true spirit and scope of the invention as set forth in the appended claims.

What is claimed is:

1. An improvement in an applicator implement having an applicator for applying a fluid material from a source to a surface, the improvement comprising:

a stem having a first end and a second end, and an outer peripheral surface extending along the stem between the first end and the second end, in a direction along an axis;

an applicator including a first portion secured to the stem adjacent the first end of the stem and a second portion projecting beyond the first end in a direction away from the second end, the first portion of the applicator being spaced inwardly from the outer peripheral surface toward the axis, and the second portion having an outer peripheral boundary;

a transverse area extending across the stem, adjacent the first end of the stem, between the outer peripheral surface and the outer peripheral boundary; and a plurality of lumens extending through the stem from the first end to the second end, the lumens extending along the direction of the axis and spaced apart from one another, closely adjacent one another, in an array of closely adjacent lumens placed around the axis, each lumen being spaced from the axis and from the outer peripheral surface to lie between the axis and the outer peripheral surface, each lumen having an inlet adjacent the second end of the stem for receiving fluid material to be conducted from the source through the lumen, an outlet adjacent the first end of the stem for delivering the fluid material received at the inlet, and a transverse cross-sectional area, at least at the outlet, substantially smaller than the transverse area adjacent the first end of the stem, each outlet being located between the outer peripheral boundary of the second portion of the applicator and the outer peripheral surface and juxtaposed with the outer peripheral boundary of the second portion of the applicator, the outlets being separate from one another and placed around the axis in an array of closely adjacent outlets surrounding the second portion of the applicator with closely adjacent separate outlets corresponding to the plurality of lumens in the array of lumens for delivering the fluid material in a plurality of closely adjacent separate streams of relatively small cross-sectional area corresponding to the plurality of closely adjacent separate outlets, with the streams arrayed around the second portion of the applicator to surround the second portion of the applicator and be directed to lay down the delivered fluid material along the second portion of the applicator in an array of closely adjacent separate streams of relatively small cross-sectional area at the outer peripheral boundary of the second portion of the applicator.

2. The improvement of claim 1 wherein the lumens extend generally parallel to the axis.

3. The improvement of claim 1 wherein the stem includes a bore extending from the first end toward the second end and spaced inwardly from the array of lumens toward the axis, and the first portion of the applicator is secured in the bore.

4. The improvement of claim 3 wherein the bore extends from the first end of the stem to the second end.

5. The improvement of claim 3 wherein at least some of the lumens are spaced outwardly from the bore so as to be separated from the bore.

6. The improvement of claim 5 wherein the outlet of each of at least some of the lumens is located closely adjacent to and spaced outwardly from the outer peripheral boundary.

7. An improvement in an applicator implement having an applicator for applying a fluid material from a source to a surface, the improvement comprising:

a stem having a first end and a second end, and an outer peripheral surface extending along the stem between the first end and the second end, in a direction alone an axis;

an applicator including a first portion secured to the stem adjacent the first end of the stem and a second portion protecting beyond the first end in a direction away from the second end, the first portion of the applicator being spaced inwardly from the outer peripheral surface toward the axis, and the second portion having an outer peripheral boundary;

a transverse area extending across the stem, adjacent the first end of the stem, between the outer peripheral surface and the outer peripheral boundary; and a plurality of lumens extending through the stem from the first end to the second end, the lumens extending along the direction of the axis and spaced part from one another in an array around the axis, each lumen being spaced from the axis and from the outer peripheral surface to lie between the axis and the outer peripheral surface, each lumen having an inlet adjacent the second and of the stem for receiving fluid material to be conducted from the source through the lumen, an outlet adjacent the first end of the stem for delivering the fluid material received at the inlet, and a transverse cross-sectional area, at least at the outlet, substantially smaller than the transverse area adjacent the first end of the stem, each outlet being located between the outer peripheral boundary of the second portion of the applicator and the outer peripheral surface and juxtaposed with the outer peripheral boundary of the second portion of the applicator for delivering the fluid material in a plurality of separate streams of relatively small cross-sectional area corresponding to the plurality of lumens, with the streams directed to lay down the delivered fluid material along the second portion of the applicator at the outer peripheral boundary of the second portion of the applicator;

the stem including a bore extending from the first end toward the second end and spaced inwardly from the array of lumens toward the axis, the first portion of the applicator being secured in the bore; and the lumens each including a length extending along the stem, and at least some of the lumens communicating with the bore along at least a portion of the length of the lumens.

8. The improvement of claim 7 wherein the at least some of the lumens communicate with the bore at the outlets of the at least some of the lumens.

9. The improvement of claim 1 including a source of fluid material attached to the stem at the second end of the stem.

10. The improvement of claim 9 wherein the source includes a container for containing a reservoir of the fluid material.

11. The improvement of claim 10 wherein the container includes a resiliently flexible wall for selective flexing to drive fluid material from the reservoir into the inlet of each lumen.

12. The improvement of claim 1 including a syringe integrated with the stem adjacent the second end of the stem for containing a reservoir of fluid material and driving selected amounts of the fluid material from the reservoir into the inlets of the lumens.

13. The improvement of claim 1 including a pump integrated with the stem adjacent the second end of the stem for driving selected amounts of fluid material into the inlets of the lumens.

14. The improvement of claim 13 including a cap integrated with the stem adjacent the second end of the stem, the cap being adapted for coupling with a bottle containing a supply of fluid material such that fluid material selectively is drawn through the outlets of the lumens, through the lumens, and into the pump for subsequent selective driving by the pump into the inlets of the lumens and delivery through the outlets of the lumens.

15. The improvement of claim 14 wherein the pump comprises a dropper bulb for containing a reservoir of fluid material drawn from the supply in the bottle and driving selected amounts of the fluid material from the reservoir into the inlets of the lumens.

16. The improvement of claim 1 wherein the stem comprises a cylindrical shaft and the axis comprises a central axis of the shaft, the outer peripheral surface comprises a cylindrical surface, and the array of lumens comprises a cylindrical array extending around the central axis and spaced radially inwardly from the cylindrical surface and radially outwardly from the outer peripheral boundary of the second portion of the applicator.

17. The improvement of claim 1 wherein the applicator implement comprises a brush, the applicator comprises bristles and the second portion comprises a bristle group projecting beyond the first end of the stem.

18. The improvement of claim 17 wherein the stem comprises a cylindrical shaft and the axis comprises a central axis of the shaft, the outer peripheral surface comprises a cylindrical surface, and the array of lumens comprises a cylindrical array extending around the central axis and spaced radially inwardly from the cylindrical surface and radially outwardly from the outer peripheral boundary of the second portion of the bristle group.

* * * * *